US008737861B2

(12) United States Patent
Hase et al.

(10) Patent No.: US 8,737,861 B2
(45) Date of Patent: May 27, 2014

(54) FIXING DEVICE AND IMAGE FORMING APPARATUS

(75) Inventors: Takamasa Hase, Kanagawa (JP); Masanao Ehara, Kanagawa (JP); Tadashi Ogawa, Tokyo (JP); Takeshi Uchitani, Kanagawa (JP); Satoshi Ueno, Tokyo (JP); Teppei Kawata, Kanagawa (JP); Kazuya Saito, Kanagawa (JP); Shuutaroh Yuasa, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 245 days.

(21) Appl. No.: 13/212,718

(22) Filed: Aug. 18, 2011

(65) Prior Publication Data

US 2012/0045226 A1 Feb. 23, 2012

(30) Foreign Application Priority Data

Aug. 19, 2010 (JP) ..... 2010-184388

(51) Int. Cl.
*G03G 15/20* (2006.01)

(52) U.S. Cl.
USPC ..... 399/70; 399/33; 399/67; 399/122

(58) Field of Classification Search
USPC ..... 399/33, 67, 69, 70.122
See application file for complete search history.

(56) References Cited

U.S. PATENT DOCUMENTS

| | | | |
|---|---|---|---|
| 5,287,155 | A | 2/1994 | Arai et al. |
| 7,266,336 | B2 | 9/2007 | Ueno et al. |
| 7,450,872 | B2 | 11/2008 | Ueno et al. |
| 7,491,917 | B2 | 2/2009 | Ueno |
| 7,509,085 | B2 | 3/2009 | Yoshinaga et al. |
| 7,693,439 | B2 | 4/2010 | Seo et al. |
| 7,715,774 | B2 | 5/2010 | Ueno |
| 7,734,208 | B2 | 6/2010 | Seo et al. |
| 7,778,581 | B2 | 8/2010 | Seo et al. |
| 7,783,240 | B2 | 8/2010 | Ito et al. |
| 7,796,933 | B2 | 9/2010 | Ueno et al. |
| 7,801,457 | B2 | 9/2010 | Seo et al. |

(Continued)

FOREIGN PATENT DOCUMENTS

| | | |
|---|---|---|
| JP | 4-220676 | 8/1992 |
| JP | 07-311512 | 11/1995 |

(Continued)

OTHER PUBLICATIONS

Office Action issued Feb. 4, 2014, in Japanese Patent Application No. 2010-184388, filed Aug. 19, 2010 (3 pages).

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A fixing device includes a fixing rotation body heating and fixing an unfixed image onto a recording medium; a pressing rotation body pressing the recording medium to the fixing rotation body; and a temperature detection unit detecting a temperature of the pressing rotation body. Further, when a predetermined time period elapses since a warm-up operation has started before a temperature detected by the temperature detection unit is equal to or greater than a predetermined temperature or when the temperature detected by the temperature detection unit is equal to or greater than the predetermined temperature before the predetermined time period elapses since a warm-up operation has started, the fixing device determines that the warm-up operation is finished.

8 Claims, 8 Drawing Sheets

(56) References Cited

U.S. PATENT DOCUMENTS

| | | | | |
|---|---|---|---|---|
| 7,817,952 | B2 | 10/2010 | Seo et al. | |
| 7,885,590 | B2 | 2/2011 | Seo et al. | |
| 7,925,177 | B2 | 4/2011 | Ishii et al. | |
| 2007/0014600 | A1 | 1/2007 | Ishii et al. | |
| 2007/0223952 | A1* | 9/2007 | Ishikawa | 399/69 |
| 2007/0280754 | A1 | 12/2007 | Ogawa et al. | |
| 2008/0025773 | A1 | 1/2008 | Ito et al. | |
| 2008/0063443 | A1 | 3/2008 | Yoshinaga et al. | |
| 2008/0317532 | A1 | 12/2008 | Ehara et al. | |
| 2009/0123201 | A1 | 5/2009 | Ehara et al. | |
| 2009/0208238 | A1* | 8/2009 | Higashi et al. | 399/69 |
| 2009/0245897 | A1 | 10/2009 | Seo et al. | |
| 2009/0297197 | A1 | 12/2009 | Hase | |
| 2010/0014903 | A1 | 1/2010 | Seto et al. | |
| 2010/0061753 | A1 | 3/2010 | Hase | |
| 2010/0074667 | A1 | 3/2010 | Ehara et al. | |
| 2010/0158553 | A1 | 6/2010 | Ueno | |
| 2010/0232844 | A1 | 9/2010 | Saito et al. | |
| 2010/0239292 | A1 | 9/2010 | Fujita et al. | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052277 | A1 | 3/2011 | Ueno et al. | |
| 2011/0058862 | A1 | 3/2011 | Yamaguchi et al. | |
| 2011/0058863 | A1 | 3/2011 | Shinshi et al. | |
| 2011/0064443 | A1 | 3/2011 | Iwaya et al. | |
| 2011/0064451 | A1 | 3/2011 | Yamaguchi et al. | |
| 2011/0064490 | A1 | 3/2011 | Imada et al. | |
| 2011/0064502 | A1 | 3/2011 | Hase et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0176821 | A1 | 7/2011 | Hase | |
| 2011/0176822 | A1 | 7/2011 | Ishii et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |

FOREIGN PATENT DOCUMENTS

| | | |
|---|---|---|
| JP | 10-326054 | 12/1998 |
| JP | 2000-194228 | 7/2000 |
| JP | 2001-051541 | 2/2001 |
| JP | 2001-305904 | 11/2001 |
| JP | 2002-55555 | 2/2002 |
| JP | 2002-148995 | 5/2002 |
| JP | 2002-169413 | 6/2002 |
| JP | 2002-174985 | 6/2002 |
| JP | 3478761 | 10/2003 |
| JP | 2005-062491 | 3/2005 |
| JP | 3777722 | 3/2006 |
| JP | 2006-301428 | 11/2006 |
| JP | 2007-148127 | 6/2007 |
| JP | 2009-031637 | 2/2009 |
| JP | 2009-294591 | 12/2009 |

* cited by examiner

FIXING DEVICE AND IMAGE FORMING APPARATUS

CROSS-REFERENCE TO RELATED APPLICATIONS

The present application claims priority under 35 U.S.C. §119 to Japanese Patent Application No. 2010-184388 filed Aug. 19, 2010, the entire contents of which are hereby incorporated herein by reference

BACKGROUND OF THE INVENTION

1. Field of the Invention

The present invention generally relates to a fixing device fixing an unfixed image onto a recording medium and an image forming apparatus including the fixing device.

2. Description of the Related Art

An image forming apparatus such as a copier, a facsimile machine, a printer, and a printing machine has been used to obtain a copy or recorded medium by fixing (i.e., heating and pressing) an unfixed image onto a recording medium, the unfixed image having been transferred and carried on the recording medium. In the fixing, the recording medium on which the unfixed image is carried is heated and pressed while being fed and sandwiched, so that a developer, especially toner, included in the unfixed image is melted and softened to penetrate into the recording medium. By doing this, the toner may be fixed into the recording medium.

To perform fixing, it may be necessary to heat a fixing member to a predetermined temperature. Namely, to perform the fixing, it may be necessary to perform a warm-up operation. Whether the warm-up operation is finished is determined based on various methods, and one example of the methods is described below.

For example, Japanese Patent No. 3777722 (hereinafter "Patent Document 1") discloses a fixing device in which a non-contact-type first temperature sensor is provided at a sheet feeding region of the fixing roller and a contact-type second temperature sensor is provided at a non-sheet feeding region of the fixing roller. The second temperature sensor at the non-sheet feeding region is used to determine whether the warm-up operation is finished, and the first temperature sensor at the sheet feeing region is used to control the temperature of the fixing roller. As described above, in Patent Document 1, determining whether the warm-up operation is finished is based on the temperature of the fixing roller.

SUMMARY OF THE INVENTION

According to an embodiment of the present invention, a fixing device includes a fixing rotation body in contact with a side of a recording medium, an unfixed image formed on the side of the recording medium, and heating and fixing the unfixed image onto the recording medium; a pressing rotation body in contact with a side of the recording medium, no unfixed image being formed on the side of the recording medium, and pressing the recording medium to the fixing rotation body; and a temperature detection unit detecting a temperature of the pressing rotation body. Further in a case where an input voltage rate to the fixing device is equal to or greater than a predetermined value and an outside air temperature is equal to or greater than a predetermined value, when a predetermined time period elapses since a warm-up operation has started before a temperature detected by the temperature detection unit is equal to or greater than a predetermined temperature or when the temperature detected by the temperature detection unit is equal to or greater than the predetermined temperature before the predetermined time period elapses since a warm-up operation has started, the fixing device determines that the warm-up operation is finished.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

Figure 1:
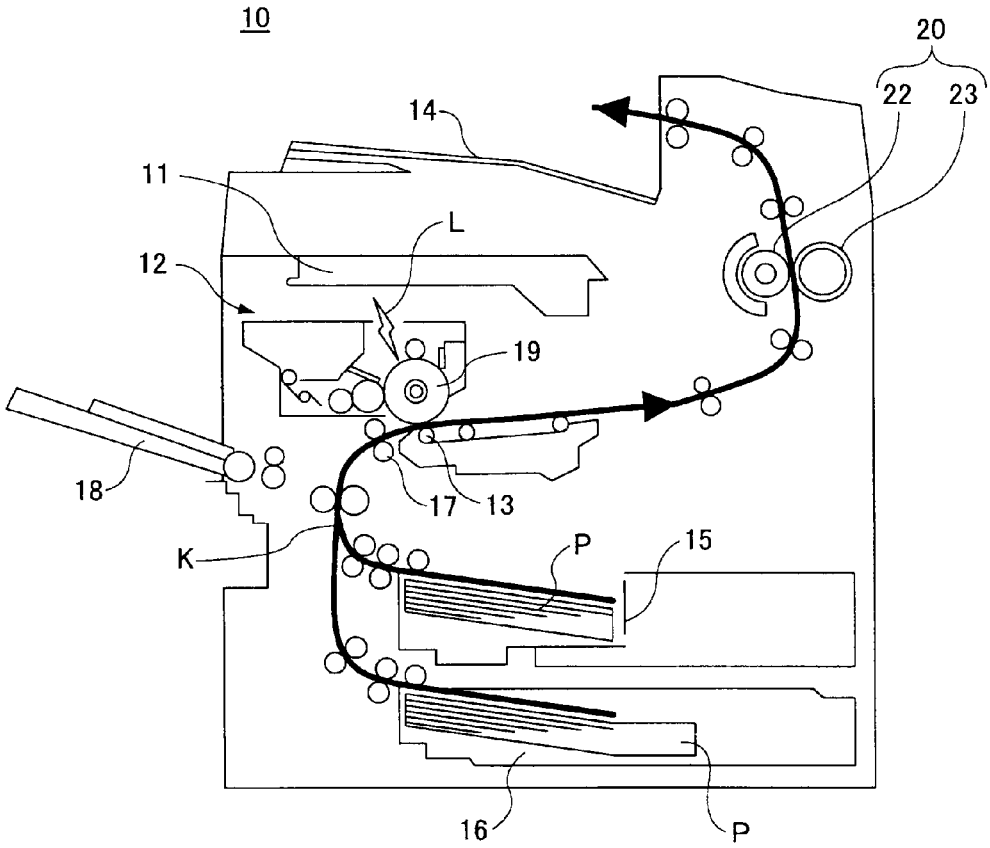
FIG. 1 is a drawing illustrating an image forming apparatus according to an embodiment of the present invention.

In order to accurately determine whether the warm-up operation is finished, it may be necessary to determine whether heat is sufficiently accumulated in the fixing roller. This is because even when the temperature of the surface of the fixing roller is equal to or greater than a predetermined temperature, there may be case where sufficient heat is not accumulated inside the fixing roller. In such a case, when the fixing operation is performed, the temperature of the surface of the fixing roller may be easily lowered because insufficient heat in the fixing roller is quickly consumed by the recording media. In such a case, an appropriate (desired) fixing operation may not be performed. To prevent the inconvenience, it may be necessary to detect or estimate whether sufficient heat is accumulated in the fixing roller, and determine whether the warm-up operation is finished based on a result of the detection or the estimation.

In the example of Japanese Patent No. 3777722 (hereinafter "Patent Document 1"), whether the warm-up operation is finished is determined based on the contact-type second temperature sensor disposed at the non-sheet feeding region of the fixing roller. As a result, only the temperature of the surface of the fixing roller is detected, and it may not possible to determine (detect) whether sufficient heat is accumulated (transferred) in the fixing roller. Because of this feature, in the technique of Patent Document 1, it may not possible to properly (accurately) determine whether the warm-up operation is finished.

The present invention is made in light of the above circumstances, and may provide a fixing device capable of eliminating the generation of unnecessary wait time and appropriately determining whether the warm-up operation is finished. Also there is provided an image forming apparatus including the fixing device.

In the following, an embodiment of the present invention is described with reference to the accompanying drawings. In the figures, the same reference numerals and the same symbols are used to describe the same elements, and repeated description thereof may be omitted.

Configuration and Operation of Image Forming Apparatus

First, an exemplary configuration and operation of an image forming apparatus according to an embodiment of the present invention is described. FIG. 1 illustrates an image forming apparatus according to this embodiment of the present invention. As illustrated in FIG. 1, an image forming apparatus 10 includes an exposure section 11, a process cartridge 12, a transfer section 13, a discharge tray 14, sheet feeding sections 15 and 16, a resist roller 17, a manual sheet feeding section 18, a photosensitive drum 19, a fixing device 20 and a controller (not shown). For example, the image forming apparatus 10 is a printer.

The exposure section 11 radiates exposure light L corresponding to image information onto the photosensitive drum 19. The process cartridge 12 serves as an image forming section and is removably provided in the image forming apparatus 10. The transfer section 13 transfers a toner image formed on the photosensitive drum 19 onto a recording medium P such as a transfer sheet. The discharge tray 14 is used to place an output image (recording medium P on which the toner image is fixed). The sheet feeding sections 15 and 16 are used to contain the recording medium P. The resist roller 17 feeds the recording medium P to the transfer section 13. The manual sheet feeding section 18 is used to, for example, feed a recording medium having a size different from that of the recording medium P contained in the sheet feeding sections 15 and 16. The fixing device 20 includes a fixing sleeve 22 and a pressing roller 23, and fixes an unfixed image which is formed on the recording medium P onto the recording medium P.

Next, a typical image forming operation of forming an image in the image forming apparatus 10 is briefly described. First, the exposure light L such as laser light corresponding to the image information is radiated from the exposure section 11 (writing section) onto the photosensitive drum 19 of the exposure section 11. The photosensitive drum 19 rotates in the counterclockwise direction. After predetermined processes (e.g., charging, exposing, and developing processes) are performed, a toner image corresponding to the image information is formed on the photosensitive drum 19. After that, in the transfer section 13, the toner image formed on the photosensitive drum 19 is transferred onto the recording medium which is fed by the resist roller 17.

On the other hand, the recording medium P to be fed to the transfer section 13 is operated as in the following. First, one of the sheet feeding sections 15 and 16 is automatically or manually selected. Herein, it is assumed that the uppermost sheet feeding section 15 is selected. The sheet feeding sections 15 and 16 may contain recording media P having respective sizes different from each other. Otherwise, for example, the sheet feeding sections 15 and 16 may contain recording media P having the same size but having different feeding directions from each other.

Then, one recording medium P on the top of the recording media P contained in the sheet feeding section 15 is fed to the position on the feeding path K of FIG. 1. After that, the recording medium P passes through the feeding path K and is fed to the position of the resist roller 17. The recording medium P at the position of the resist roller 17 is further fed to the transfer section 13 at an appropriate timing to align the printing position of the toner image formed on the photosensitive drum 19.

After the transfer process, after passing through the position of the transfer section 13, the recording medium P further passes through the feeding path K to be fed to the fixing device 20. The recording medium P fed to the fixing device 20 is further fed into a nip (nip section) between the fixing sleeve 22 and the pressing roller 23. Due to the heat from the fixing sleeve 22 and the pressure from the pressing roller 23, the toner image is fixed onto the recording medium P. The recording medium P onto which the toner image is fixed is fed from the nip between the fixing sleeve 22 and the pressing roller 23, and is ejected from the image forming apparatus 10 to the position on the discharge tray 14 as an output image (i.e., recording medium P onto which the toner image has been fixed).

Further, the controller (not shown) performs various controls on the image forming apparatus 10 including the fixing device 20 including various temperature sensors (temperature detection unit) described below. For example, the controller (not shown) includes a CPU, a ROM, a main memory and the like, so that various functions of the controller are realized by loading corresponding programs recorded in the ROM or the like to the main memory and executing the loaded programs by the CPU. However, a part or all of the controller (not shown) may be realized only by hardware. Further, the controller (not shown) may be constituted by plural devices which are physically different from each other.

As described above, a series of the image forming processes is finished. In the above description, a case is described in which the image forming apparatus 10 prints a single color. However, for example, the image forming apparatus 10 may be made a full-color printer by replacing the process cartridge 12 with a process with cartridge corresponding four colors (i.e. CMYK).

Configuration and Operation of Fixing Device

Figure 2:
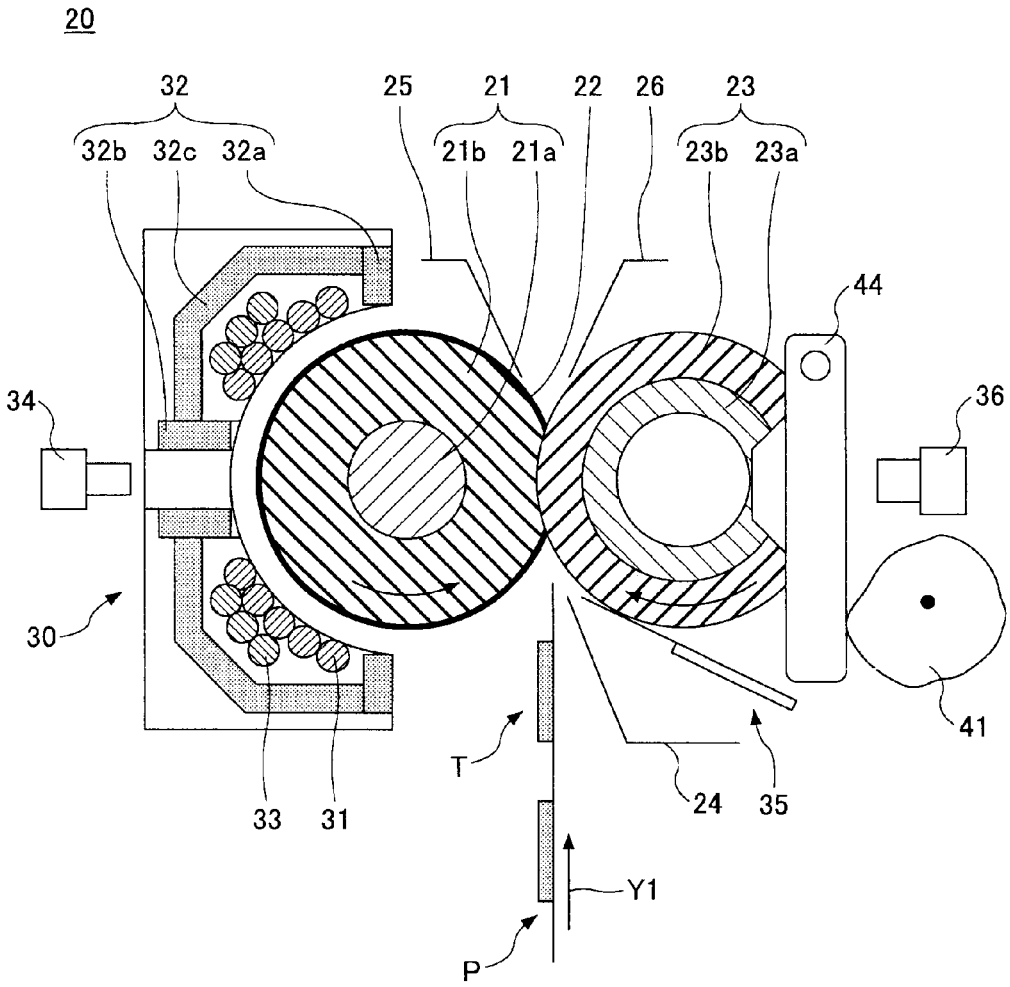
FIG. 2 is a drawing illustrating an example of a fixing device according to the embodiment of the present invention.
Figure 3:
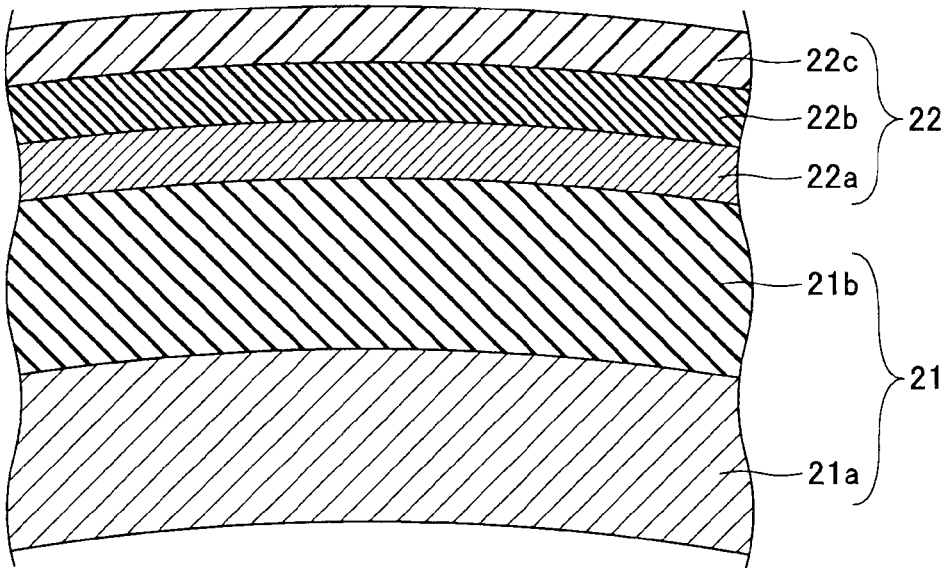
FIG. 3 is an enlarged drawing of a fixing roller and a fixing sleeve in FIG. 2.

Next, a configuration and operations of a fixing device according to an embodiment of the present invention is described. FIG. 2 illustrates an example of a fixing device according to an embodiment of the present invention. FIG. 3 is an enlarged drawing illustrating a fixing roller and the fixing sleeve. As illustrated in FIGS. 2 and 3, the fixing device 20 includes a fixing roller 21, the fixing sleeve 22, the pressing roller 23, an induction heater 30, a thermopile 34, a contact-type thermistor 35, a non-contact-type thermistor 36 and the like. Herein, the symbol "T" denotes a toner image (toner) of an unfixed image (hereinafter may be referred to as "toner image T").

The fixing sleeve 22 is provided to be in contact with a side (surface) of the recording medium P, the toner image T (i.e., unfixed image) being formed on the side, so that the fixing sleeve 22 heats and fixes the toner image T onto the recording medium P. The fixing sleeve 22 includes a base material 22*a*, an elastic layer 22*b*, and a release layer 22*c*. The base material 22*a* is made of a metal material and has a thickness in a range, for example, from 30 μm to 50 μm. The elastic layer 22*b* and the release layer 22*c* are sequentially formed on the surface of the base material 22*a*. For example, the outer diameter of the fixing sleeve 22 is 40 mm. As a material of forming the fixing sleeve 22, for example, magnetic metal materials such as Fe, Co, Ni, and an alloy which is any combination thereof may be used. For example, the elastic layer 22*b* may be made of an elastic member such as silicone rubber and has a thickness of 150 μm. By using the base material 22*a* and the elastic layer 22*b* described above, it may become possible to determine a heat capacity of the fixing roller 21 in an appropriate range and obtain a fixed image having good quality without irregular fixing (fixing failure) occurring. The release layer 22*c* is made of a fluoride compound such as PFA (polytetrafluoroethylene) and has a tube-like shape for coating. For example, the thickness of the release layer 22*c* is 50 μm. The release layer 22*c* is provided to enhance the release performance of the toner on the surface of the fixing sleeve 22, the toner image (toner) T being in direct contact with the surface of the fixing sleeve 22.

The fixing roller 21 holds the fixing sleeve 22. The fixing roller 21 includes a core metal 21*a* and an elastic layer 21*b*. The core metal 21*a* is made of a metal material such as stainless steel and has a cylindrical shape. The elastic layer 21*b* is made of a thermally-resistant material such as silicone foam. For example, the outer diameter of the fixing roller 21 is 40 mm. For example, the thickness of the elastic layer 21*b* is 9 mm, and Asker hardness of the elastic layer 21*b* is in a range from 30 degrees to 50 degrees. The fixing roller 21 is in contact with the inner-periphery of the fixing sleeve 22 so as to hold the fixing sleeve 22 like a roller. The fixing roller 21 and the fixing sleeve 22 constitute one typical example of a fixing rotation body according to the present invention.

The pressing roller 23 is provided to be in contact with another side of the recording medium P, no toner image T (unfixed image) being formed on the other side. The pressing roller 23 presses the recording medium P toward the fixing sleeve 22. In a case where the unfixed image is to be fixed to one side (surface) of the recording medium while an image is already formed (fixed) on the other side of the recording medium P (i.e., in both-sided printing), the recording medium P is fed into the nip between the fixing sleeve 22 and the pressing roller 23 in a manner such that the pressing roller 23 is in contact with the side on which the image is already formed (fixed) and the fixing sleeve 22 is in contact with the side on which the unfixed image is to be fixed.

The pressing roller 23 includes a core rod 23*a*, an elastic layer 23*b*, and a release layer (not shown). The core rod 23*a* is made of a metal material having high thermal conductivity such as aluminum or copper. The elastic layer 23*b* is made of a thermally-resistant material such as silicone rubber.

The elastic layer 23*b* and the release layer are sequentially formed on the core rod 23*a*. For example, the outer diameter of the pressing roller 23 is 40 mm. For example, the thickness of the elastic layer 23*b* is 2 mm. For example, the release layer is made of PFA and has a tube-like shape for coating. For example, the thickness of the release layer is 50 μm. The pressing roller 23 is provided to be in press-contact with the fixing roller 21 via the fixing sleeve 22. When the pressing roller 23 is in press-contact with the fixing roller 21, a nip section is formed between the pressing roller 23 and the fixing roller 21. The recording medium P is fed into the nip section. The pressing roller 23 is a typical example of a pressing rotation body.

The induction heater 30 includes an exciting coil 31, a core 32, and a degaussing coil 33. The exciting coil 31 is formed by winding a Litz wire on a coil guide provided so as to cover a part of the outer periphery of the fixing sleeve 22. The Litz wire is made of a bundle of thin wires. As a result, the exciting coil 31 is formed so as to extend in the width direction of the recording medium P (i.e., extend in the direction orthogonal to the plane of the drawing sheet). The degaussing coil 33 is symmetrically disposed relative to the width direction of the recording medium P. Further, the degaussing coil 33 is provided on the exciting coil 31. The core 32 is made of a ferromagnetic body such as ferrite (having a relative permeability of approximately 2500). To form an effective magnetic flux, the core 32 includes a center core 32*b*, a side core 32*a*, and an arch core 32*c*. The core 32 is provided so as to face the exciting coil 31 disposed in the width direction of the recording medium P (i.e., in the width direction of the fixing roller 21).

The thermopile 34 is disposed substantially at the center part in the width direction of the fixing sleeve 22 in order to detect the temperature of the fixing sleeve 22. The thermopile 34 is a non-contact-type temperature sensor that can extremely accurately detect (measure) a temperature of a measurement target.

The contact-type thermistor 35 is a temperature detection unit that detects a temperature of a non-sheet feeding region of the pressing roller 23. The contact-type thermistor 35 is disposed outside of a maximum-sheet-feeding region in the width direction of the pressing roller 23. Herein, the term "maximum-sheet-feeding region" refers to a region outside a passing region in the width direction of the pressing roller 23, the passing region being a region through which the recording medium having the maximum width is fed (passes) when the fixing device 20 is able to feed plural sizes of recording media such as A3T and A5T sheets having different sizes in the width direction from each other. By disposing the contact-type thermistor 35 outside the maximum-sheet-feeding region in the width direction of the pressing roller 23, it may become possible to prevent the damaging of the maximum-sheet-feeding region of the pressing roller 23. The contact-type thermistor 35 may be less expensive than the thermopile 34. On the other hand, the detection accuracy of the contact-type thermistor 35 may be lower than that of the thermopile 34.

The non-contact-type thermistor 36 is a temperature detection unit that detects a temperature of a sheet feeding region of the pressing roller 23. When compared with the contact-type thermistor 35, the non-contact-type thermistor 36 is disposed at a position closer to the center part in the width direction of the pressing roller 23. However, when the fixing device 20 is able to feed plural sizes of recording media such as A3T and A5T sheets having different sizes in the width direction from each other, the non-contact-type thermistor 36 may be disposed at a position corresponding to the non-sheet feeding region when a recording medium having a smaller width size (e.g., A5T sheet) is fed and corresponding to the sheet feeding region when a recording medium having a larger width size (e.g., A3T sheet) is fed (e.g., see the position of the non-contact-type thermistor 36 in FIG. 7). Namely, while the contact-type thermistor 35 is disposed outside the maximum-sheet-feeding region which is the non-sheet feeding region corresponding to any of the recording media P, the non-contact-type thermistor 36 is disposed in the sheet feeding region corresponding to at least the recording medium having the greatest width. Herein, the symbol "A3T" denotes a case where the recording medium having the A3 size is fed in the vertical direction (i.e., in a manner such that the longitudinal direction of the recording medium corresponds to the feeding direction of the recording medium). In the same manner, the symbol "A5T" denotes a case where the recording medium having the A5 size is fed in the vertical direction (i.e., in a manner such that the longitudinal direction of the recording medium corresponds to the feeding direction of the recording medium).

The non-contact-type thermistor 36 is provided in a manner such that the non-contact-type thermistor 36 is separated from the pressing roller 23 by a predetermined gap distance. Therefore, when compared with a contact-type temperature sensor contacting with the pressing roller 23, the non-contact-type thermistor 36 may have higher durability and may not cause inconvenience such as damage of the surface of the pressing roller 23. Further, the non-contact-type thermistor 36 may be less expensive than the thermopile 34. On the other hand, the detection accuracy of the non-contact-type thermistor 36 may be worse than that of the thermopile 34.

Next, an operation of the fixing device 20 having the above configuration is described. When the pressing roller 23 is rotationally driven by a drive motor (not shown) in the clockwise direction of FIG. 2, the fixing sleeve 22 rotates in the counterclockwise direction. Then, the fixing sleeve 22 is heated at the position facing the induction heater 30 due to the magnetic flux generated by the induction heater 30.

More specifically, by flowing an alternating current having a high frequency in a range from 10 kHz to 1 MHz (preferably in a range from 20 kHz to 800 kHz) through the exciting coil 31, magnetic lines are formed near the fixing sleeve 22 facing the exciting coil 31 in a manner such that the directions of the magnetic lines are alternately change. Due to the generated alternating magnetic field, an eddy current is generated (excited) in the base material (heat generation layer) 22*a* of the fixing sleeve 22. As a result, the fixing sleeve 22 is induction-heated due to Joule heat which is generated by the excited eddy current and the electric resistance of the base material (heat generation layer) 22*a*. The surface of the fixing sleeve 22 heated by the induction heater 30 is fed (moved) to the nip section between the fixing sleeve 22 (fixing roller 21) and the pressing roller 23. Then, the unfixed toner image (toner) T on the recording medium P fed to the nip section is heated and melted.

Specifically, the recording medium P carrying the toner image T as a result of predetermined image forming processes is guided by a guide plate 24 and fed into the nip section between the fixing roller 21 and the pressing roller 23 (i.e., the recording medium P is fed in the Y1 direction of FIG. 2). Then, the toner image T on the recording medium P is fixed onto the recording medium P due to the heat from the fixing roller 21 and the pressure from the pressing roller 23. Then, the recording medium P is fed from the nip section to be separated from the fixing sleeve 22 by a fixing separation plate 25 and from the pressing roller 23 by a pressing separation plate 26. The surface of the fixing sleeve 22 passing through the nip section is returned to the position facing the induction heater 30.

When sheets having a smaller size (e.g., A5T sheets) as the recording medium P are continuously fed, the degaussing coil 33 is controlled to generate an alternating magnetic field opposite to the alternating magnetic field generated by the exciting coil 31 by, for example, turning ON a relay controlled by a control circuit (not shown). Then, the magnetic field on the region where the degaussing coil 33 (corresponding to the relay which is turned ON) is disposed is reduced. As a result, the generation of the Joule heat in the fixing sleeve 22 corresponding to the non-sheet feeding region is controlled (reduced). Herein, the term "continuously fed" refers to a status where plural recording media P sequentially pass through the nip section between the fixing sleeve 22 and the pressing roller 23 at substantially regular intervals.

By repeating the series of the operations described above, the fixing process in the image forming process is finished.

The fixing device 20 includes a mechanism to change the pressing force from the pressing roller 23. Specifically, a pressure lever 44 to be in contact with an axle of the pressing roller 23 is rotatably provided relative to a center axis on one end side of the pressure lever 44. The other end side of the pressure lever 44 is in contact with a cam 41. By having this structure, when the cam 41 is rotatably driven by a driver (not shown), the pressure lever 44 moves substantially in the horizontal direction and the pressing force applied from the pressing roller 23 to the fixing sleeve 22 changes. For example, the driver includes a stepping motor and a reduction gear and the like.

Figure 4:
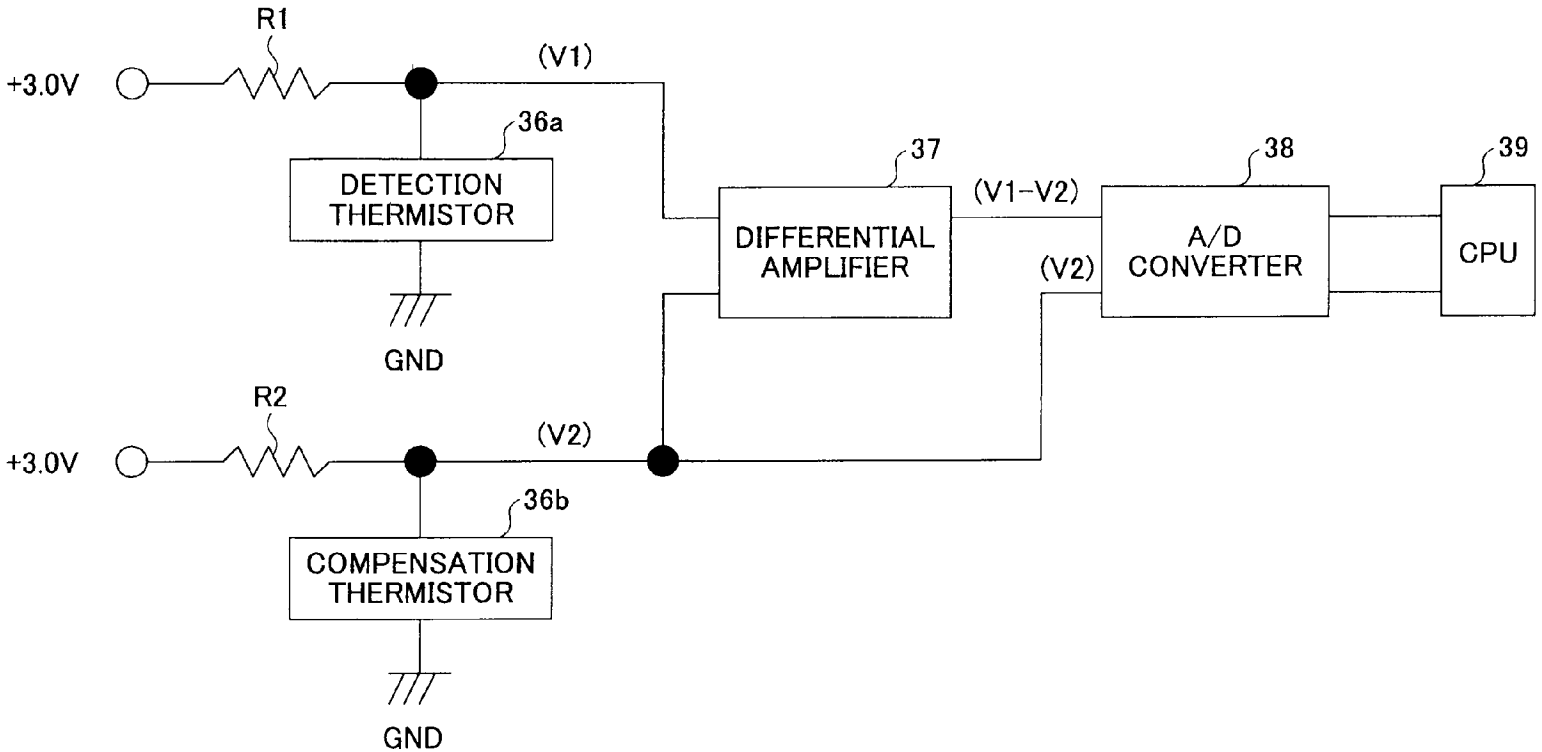
FIG. 4 is an example of a circuit diagram of a non-contact-type thermistor.

In the following, details of the characteristic configuration and operations of the fixing device according to this embodiment of the present invention are described. First, with reference to FIG. 4, an example of a circuit configuration of the non-contact-type thermistor 36 is described. As illustrated in FIG. 4, the non-contact-type thermistor 36 includes a detection thermistor 36*a* and a compensation thermistor 36*b*. The detection thermistor 36*a* detects the infrared radiation from the surface of the pressing roller 23. The compensation thermistor 36*b* detects the temperature of the detection thermistor 36*a*.

One terminal of each of the detection thermistor 36*a* and the compensation thermistor 36*b* is connected to GND (reference potential). The other terminals of the detection thermistor 36*a* and the compensation thermistor 36*b* are connected to the power supplies via the resistors R1 and R2, respectively. In this embodiment, as an example, the detection thermistor 36*a* and the compensation thermistor 36*b* are connected to power supplies outputting +3.0 V via the resistors R1 and R2, respectively.

When the detection thermistor 36*a* and the compensation thermistor 36*b* detect the change of the temperature, the voltage V1 on the R1 side of the detection thermistor 36*a* and the voltage V2 on the R2 side of the compensation thermistor 36*b*, respectively, change. Both of the voltages V1 and V2 are input to a differential amplifier 37. The differential amplifier 37 amplifies and outputs a differential voltage (V1−V2) to an A/D converter 38. Further, the voltage V2 is also input to the A/D converter 38. The differential voltage (V1−V2) and the voltage V2 (which may also be referred to as a compensation voltage) are converted into digital signals by the A/D converter 38, and the converted digital signals are input to a CPU 39. The differential voltage (V1−V2) and the voltage V2 are converted into the detection temperatures by referring to a temperature table.

Figure 5:
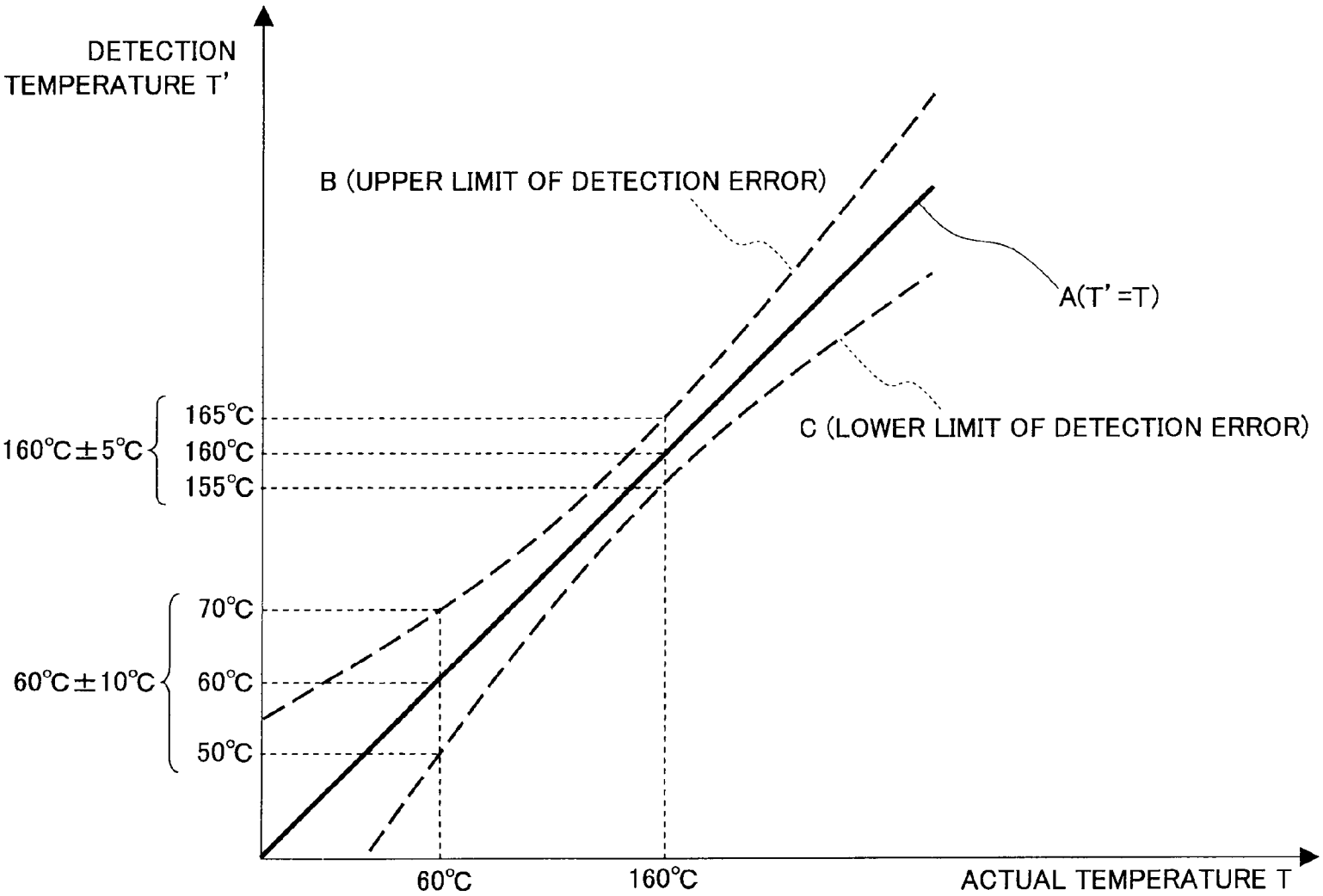
FIG. 5 is a graph illustrating a relationship between actual temperatures and detected temperatures detected by the non-contact-type thermistor.

Next, with reference to FIG. 5, a relationship between the actual temperature and the detection temperature of the surface of the pressing roller 23 is described. In the graph of FIG. 5, the lateral axis denotes the actual temperature T of the surface of the pressing roller 23. The vertical axis denotes the detection temperature T' detected by the non-contact-type thermistor 36. Further, the line A denotes a case where there is no detection error (i.e., there is no difference between the actual temperature T and the detection temperature T', (T=T')). The line B denotes the upper limit of the detection error and the line C denotes the lower limit of the detection error.

As illustrated in FIG. 5, the detection error of the non-contact-type thermistor 36 is not constant and varies depending on a temperature range to be used. In the example of FIG. 5, the detection error becomes the lowest which is approximately ±5° C. when the actual temperature T is around 160° C. Further, as the temperature is increased or lowered from 160° C., the detection error is increased. For example, when the actual temperature is around 60° C., the detection error is approximately ±10° C. On the other hand, the detection error of the contact-type thermistor 35 is substantially approximately ±3° C. in the entire use temperature range.

Next, a method of compensating for the detection error of the non-contact-type thermistor 36 is described. For example, as the power is turned ON just after an apparatus including the fixing device 20 is manufactured in a facility or as the power is turned ON after three hours or more has been passed since the power is turned OFF (i.e., the fixing device 20 is not heated), the temperature of the entire fixing device 20 is substantially equal to room temperature. Herein, it is assumed that the room temperature is in a range from 20° C. to 25° C. In this case, the detection temperature of the thermopile 34 is in the range from 20° C. 25° C. When the temperature (detection temperature) detected by the thermopile 34 having excellent accuracy is compared with the temperature detected by the non-contact-type thermistor 36 and the difference between those temperatures is given as ΔT, this compensation value ΔT is always added to the detection temperature of the non-contact-type thermistor 36. However, for the detection error if the non-contact-type thermistor 36 is not constant as illustrated in FIG. 5, it is preferable that an upper limit of the compensation value ΔT is set or the compensation value ΔT is reduced as the temperature approaches a rated temperature from 160° C.

Otherwise, when the detection temperature difference ΔT is equal to or greater than a predetermined value, there may be a case where any of the parts including the resistors R1 and R2, the differential amplifier 37, and the non-contact-type thermistor 36 is out of its tolerance (specification) or damaged. Therefore, when the detection temperature difference ΔT is equal to or greater than a predetermined value, it is thought that there is a failure in a temperature detection system including the non-contact-type thermistor 36 and the operation of the fixing device 20 is stopped. The predetermined value may be appropriately set. For example, as the predetermined value, a value approximately 10° C. may be set. By performing the control as described above, it may become possible to detect a failure (error) of the temperature detection system including the disconnection of the non-contact-type thermistor 36 and safely stop the operation of the fixing device 20. Herein, the "temperature detection system including the non-contact-type thermistor 36" refers to a part including the non-contact-type thermistor 36 and its peripheral circuits including the resistors R1 and R2, the differential amplifier 37 and the like.

Figure 6:
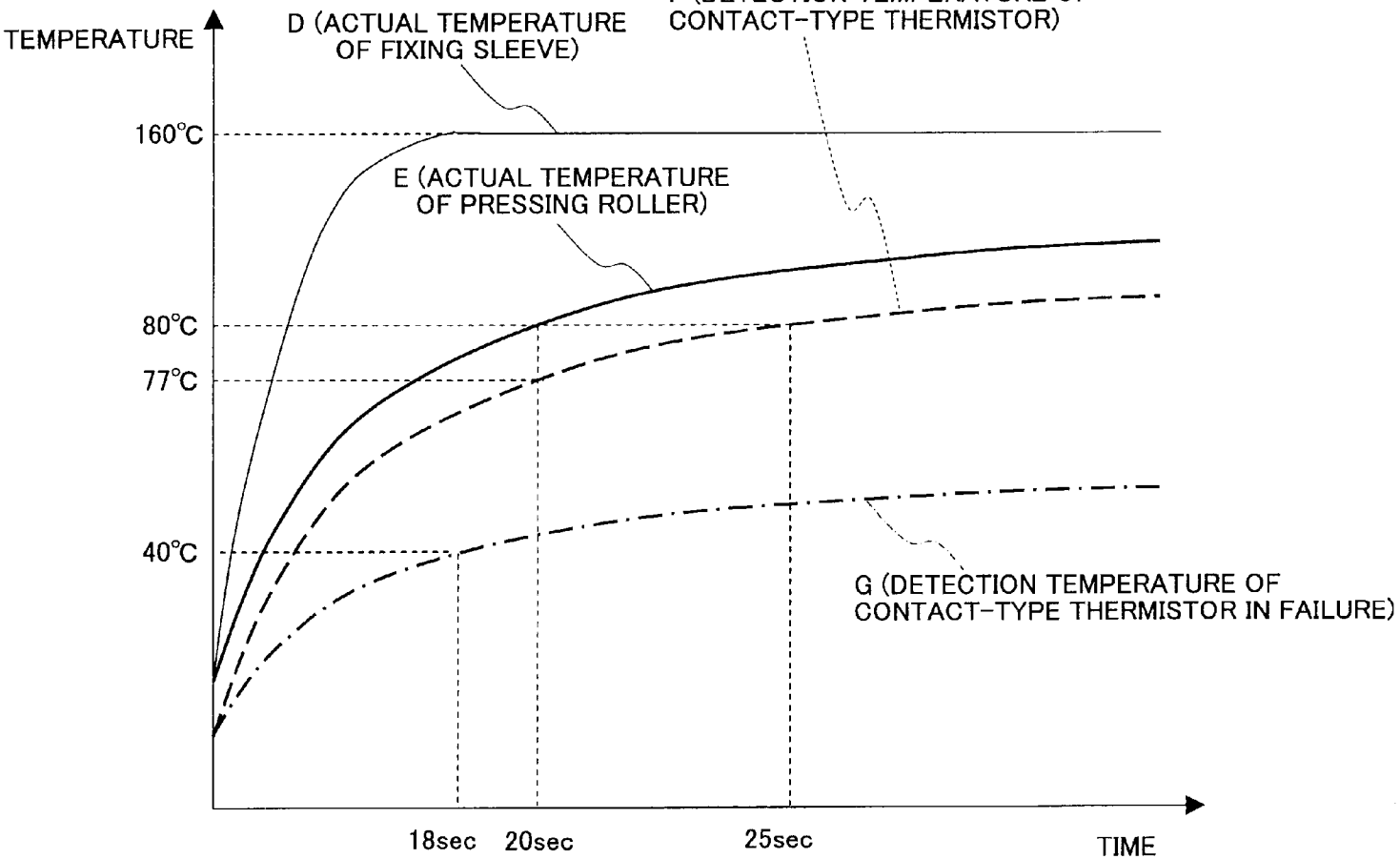
FIG. 6 is graph illustrating temperature data used for a warm-up operation.

Next, with reference to FIG. 6, a warm-up operation is described. The graph of FIG. 6 illustrates a temperature increase profile of the fixing sleeve 22 and the pressing roller 23 when 1300 W power is input to the fixing device 20 to start up the fixing device 20. In FIG. 6, the curve D denotes the actual temperature of the fixing sleeve 22. The curve E denotes the actual temperature of the pressing roller 23. The curve F denotes the detection temperature of the contact-type thermistor 35. Further, FIG. 6 illustrates a case where the detection temperature of the contact-type thermistor 35 is lower than the actual temperature of the pressing roller 23 by 3° C. Further, as described above, the detection accuracy of the thermopile 34 is high. Therefore, the actual temperature of curve D is substantially equal to the detection temperature of the thermopile 34.

First, a case is described where whether a warm-up operation is to be stopped is determined by using the contact-type thermistor 35 only. As described above, the detection error is approximately ±3° C. In the example of FIG. 6, it is assumed that the warm-up operation is finished when the actual temperature (i.e., the curve D) of the fixing sleeve 22 is 160° C. and the actual temperature (i.e., the curve E) of the pressing roller 23 is 80° C. In FIG. 6, when the actual temperature (E) of the fixing sleeve 22 is equal to the detection temperature of the contact-type thermistor 35 (i.e., detection error=0° C.), the warm-up time is 20 s (seconds). However, as illustrated in FIG. 6, when the detection temperature of the contact-type thermistor 35 is lower than the actual temperature of the fixing sleeve 22 by 3° C. (detection error=−3° C.), it takes 25 s to determine that the warm-up operation is finished. Therefore, unnecessary 5 s is generated (added).

On the other hand, according to this embodiment, whether the warm-up operation is finished is determined based on both the detection temperature of the contact-type thermistor 35 and an elapsed time since the warm-up operation has started. In this embodiment, an average time period until the actual temperature of the pressing roller 23 becomes 80° C. is obtained in advance by using, for example, a contact-type thermistor 35 having a known detection error value. Then the previously obtained average time period is set as a known warm-up time. In the example of FIG. 6, the known warm-up time is 20 s. Then, even when the detection temperature (F) of the contact-type thermistor 35 (having unknown detection error) is less than 80° C. but the known warm-up time (=20 s) elapses since the warm-up operation has started, it is determined that the actual temperature (E) of the pressing roller 23 is 80° C. and it is determined that the warm-up operation is finished. By doing in this way, it may become possible to eliminate the unnecessary wait time which is generated when determining whether the warm-up operation is finished based on only the contact-type thermistor 35 in a case where the detection error of the contact-type thermistor 35 is, for example, −3° C.

Further, in a case where the detection error of the contact-type thermistor 35 is +3° C., the detection temperature of the contact-type thermistor 35 becomes 80° C. before the known warm-up time (=20 s) elapses since the warm-up operation has started. Therefore, in this case as well, it may become possible to eliminate the generation of the unnecessary wait time.

As described above, when it is determined whether the warm-up operation is finished based on only the contact-type thermistor 35, the finish of the warm-up operation is determined when the actual temperature of the pressing roller 23 is in a range from 77° C. to 83° C. Therefore, when the finish of the warm-up operation is determined when the actual temperature of the pressing roller 23 is 83° C., the warm-up time longer than the correct warm-up time may be obtained. On the other hand, according to this embodiment of the present invention, when it is determined whether the warm-up operation is finished based on both the detection temperature of the contact-type thermistor 35 and the known warm-up time, it is determined that the warm-up operation is finished when the actual temperature of the pressing roller 23 is in a range from 77° C. to 80° C. Therefore, it may become possible to eliminate the unnecessary wait time longer than a predetermined value (e.g., 20 s in the case of FIG. 6).

In consideration of the detection error on the + side of the contact-type thermistor 35, a condition to determine that the warm-up operation is finished may be shifted (changed). For example, the condition of determining that the warm-up operation is finished is changed so that the condition is satisfied when the actual temperature (D) of the fixing sleeve 22 is 160° C., and the actual temperature (E) of the pressing roller 23 is 83° C. In this case, the finish of warm-up operation is determined when the actual temperature of the pressing roller 23 is in a range from 80° C. to 83° C.

Further, in this embodiment, in a case where the fixing device 20 has already been heated when the warm-up operation is started, if the detection temperature of the contact-type thermistor 35 reaches 80° C. before the known warm-up time elapses since the warm-up operation has started, it is determined that the warm-up operation is finished at the timing when the detection temperature of the contact-type thermistor 35 reaches 80° C.

The control described above is performed only when an input voltage rate to the fixing device 20 is equal to or greater than 95% and the outside air temperature is equal to or greater than 20° C. In any condition other than above condition, there may be a case where the actual temperature of the pressing roller 23 does not reach 80° C. even when the known warm-up time (20 s in the case of FIG. 6) elapses since the warm-up operation has started. Therefore, even when the known warm-up time (20 s in the case of FIG. 6) elapses since the warm-up operation has started, it is not determined that the warm-up operation is finished until the detection temperature of the contact-type thermistor 35 reaches 80° C. Namely, in this case, the known warm-up time is ignored and whether the warm-up operation is finished is determined based on only the detection temperature of the contact-type thermistor 35.

Herein, the term "input voltage rate" refers to a ratio of the voltage applied to the power source (power source input voltage) to the rated voltage of the power source. For example, when the rated voltage is 100 V and the power source input voltage is 95 V, the input voltage rate is 95%. When the rated voltage is 200 V in Europe or the like and the power source input voltage is 180 V, the input voltage rate is 90%. In the fixing device 20, when the input voltage rate is low, the power that can be used by the fixing device 20 may be reduced in proportion to the reduction of the input voltage rate.

As described above, in this embodiment, unlike a conventional example (where whether the warm-up operation is finished is determined based on the detection temperature of the fixing roller 21), the temperature of the pressing roller 23 is detected and it is determined whether the warm-up operation is finished based on the result of the detected temperature of the pressing roller 23. Next, a reason why whether the warm-up operation is finished is determined not based on the detection temperature of the fixing roller 21 but based on the detection temperature of the pressing roller 23 is described. The temperature of the surface of the pressing roller 23 is increased when heat is transferred from the fixing sleeve 22. At the same time, the heat generated in the fixing sleeve 22 is also transferred into the fixing roller 21 and accumulated in the fixing roller 21. Because of this feature, even in a case where the temperature of the surface of the fixing sleeve 22 reaches a predetermined temperature, when sufficient heat is not accumulated in the fixing roller 21, there may be a case where the temperature of the surface of the pressing roller 23 does not reach a predetermined temperature. However, in other words, when the temperature of the surface of the pressing roller 23 reaches the predetermined temperature, it may be possible to determine that sufficient heat is accumulated in the fixing roller 21. Therefore, in this embodiment of the present invention, whether sufficient heat is accumulated in the fixing roller 21 (i.e., heat accumulation status) is estimated (determined) by detecting the temperature of the surface of the pressing roller 23. Then, based on the result of detecting the temperature of the surface of the pressing roller 23, whether the warm-up operation is finished is determined. As a result, it may become possible to appropriately determine whether the warm-up operation is finished. Namely, it may become possible to start a fixing operation under the condition that sufficient heat is accumulated in the fixing roller 21.

Further, as described above, in this embodiment of the present invention, when the known warm-up time elapses since the warm-up operation has started, it is determined that the actual temperature of the pressing roller 23 reaches a predetermined temperature and accordingly the warm-up operation is finished. Because of this feature, it may become possible to eliminate the unnecessary wait time caused by the detection error of the contact-type thermistor 35.

The line G of FIG. 6 is a temperature profile in a failure status where, for example, the contact-type thermistor 35 is not in contact with the pressing roller 23. When the warm-up operation is finished, a print job or a standby mode is started (selected). Once the print job or the standby mode is started (selected), it may become difficult to estimate the temperature of the pressing roller 23, and it may become difficult to determine (detect) a failure of the contact-type thermistor 35. Because of this feature, it may be preferable (necessary) to detect a failure before the known warm-up time (=20 s) elapses. To that end, in this embodiment of the present invention, before a predetermined time period (which is less than the known warm-up time) elapses since the warm-up operation has started, if the detection temperature of the contact-type thermistor 35 does not reach a predetermined temperature (failure detection temperature), it is determined that the there is a failure of the contact-type thermistor 35 and the operation of the fixing device 20 is stopped. By performing the control as described above, it may become possible to detect a failure (error) of the temperature detection system including the disconnection or the contact failure of the contact-type thermistor 35 and safely stop the operation of the fixing device 20. Herein, the temperature detection system including the contact-type thermistor 35 refers to a part including the contact-type thermistor 35 and the peripheral circuits of the contact-type thermistor 35 and the like.

In this embodiment of the present invention, for example, the predetermined time period (which is less than the known warm-up time) is 18 s and the failure detection temperature is 60° C. Therefore, when the detection temperature of the contact-type thermistor 35 does not reach 60° C. or higher within 18 s, it is determined that there is a failure. In the example (line G) of FIG. 6, a temperature 60° C., lower than the failure detection temperature (60° C.) is detected after the predetermined time period (18 s) elapsed since the warm-up operation has started. Therefore, it is determined that there is a failure in the temperature detection system including the contact-type thermistor 35 and the operation of the fixing device 20 is stopped.

Further, when the warm-up operation is finished, if a print job has been received, the print job is started (and the recording medium can be fed to the fixing device 20). On the other hand, if no print job has been received, it goes to a standby mode.

Figure 7:
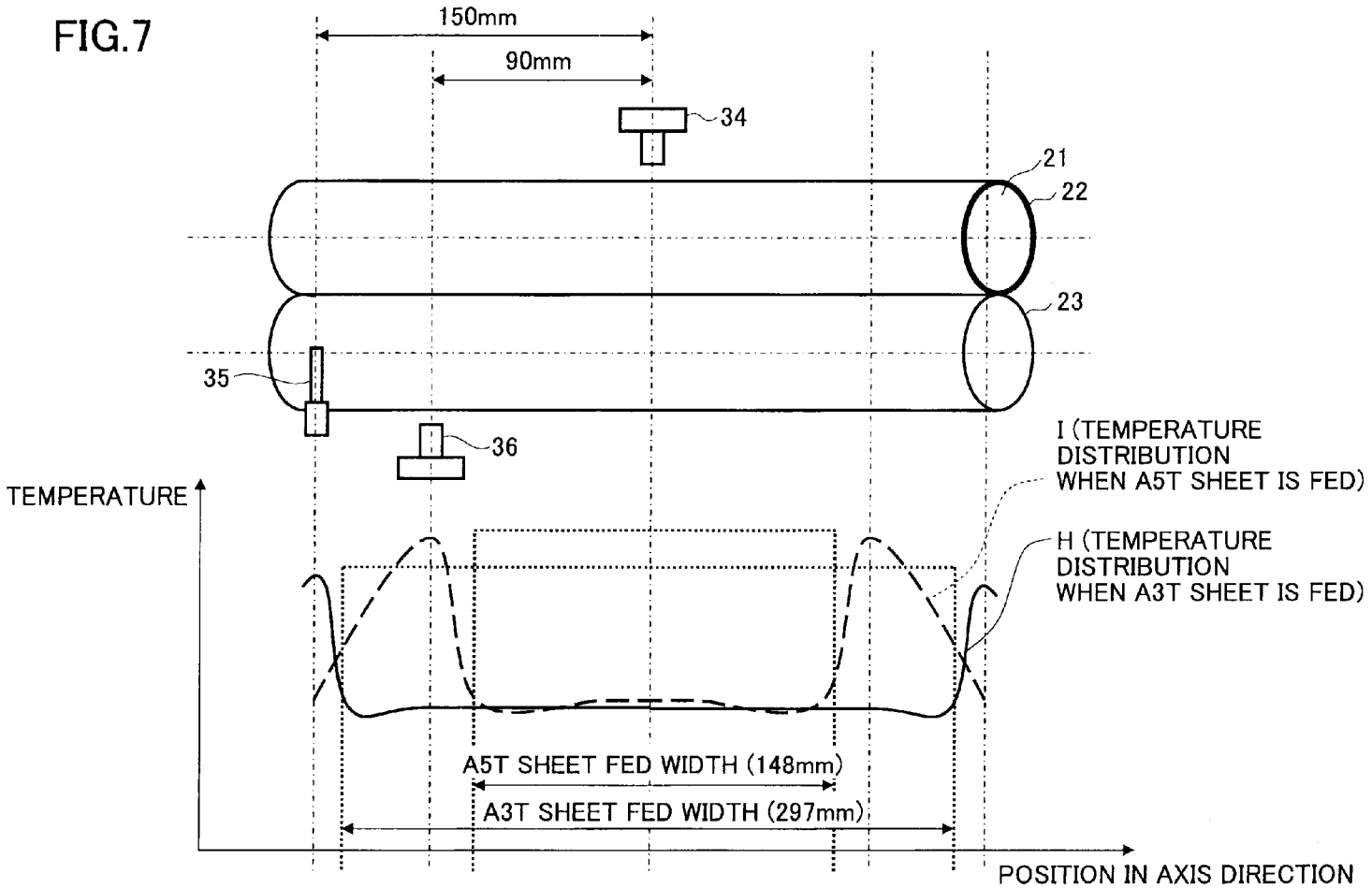
FIG. 7 is a drawing illustrating temperature characteristics when smaller or larger sheets are continuously fed.

Next, with reference to FIG. 7, an operation when the recording media having a small (width) size are continuously fed is described. In the example of FIG. 7, as the temperature sensors, there are provided the thermopile 34, the contact-type thermistor 35, and the non-contact-type thermistor 36. The thermopile 34 is disposed at a center position in the axis direction of the fixing sleeve 22 (fixing roller 21). The contact-type thermistor 35 is disposed at a position separated from the center in the axis direction of the pressing roller 23 by 150 mm. The non-contact-type thermistor 36 is disposed at a position separated from the center in the axis direction of the pressing roller 23 by 90 mm. In FIG. 7, the lateral axis denotes the position in the axis (longitudinal) direction and the vertical axis denotes the temperature of the pressing roller 23.

In FIG. 7, the curve H denotes the temperature distribution in the axis direction when A3T sheets are fed. The curve I denotes the temperature distribution in the axis direction when A5T sheets are fed. As illustrated in the curve I of FIG. 7, in the fixing device 20 according to this embodiment of the present invention, the temperature of the regions in a range from 5 mm to 15 mm outside of the sheet feeding region of the A5T sheet becomes the highest. The width of the sheet feeding region of the A3T sheet is 297 mm (148.5 mm from the center to the end in the width direction). Therefore, the contact-type thermistor 35 detects the temperature increase of the non-sheet feeding region. On the other hand, the width of the sheet feeding region of the A5T sheet is 148 mm (74 mm from the center to the end in the width direction). Therefore, the non-contact-type thermistor 36 detects the temperature increase of the non-sheet feeding region of the A5T sheet.

Next, a case is considered where the heat resistance temperature (i.e., the maximum allowable temperature) of the fixing roller 21 is approximately 220° C. In the case, it is assumed that when the temperature at a predetermined position of the fixing roller 21 in the axis direction is approximately 220° C., the temperature of the pressing roller 23 at the position corresponding to the predetermined position of the fixing roller 21 becomes 170° C. due to the heat transfer from the fixing sleeve 22 and the fixing roller 21. When the detection temperature of the non-contact-type thermistor 36 is 170° C., the detection error is ±5° C. (see FIG. 5). Therefore, the temperature of the pressing roller 23 may be determined with relatively high accuracy. Herein, to prevent the fixing roller 21 being heated beyond the heat resistance temperature of the fixing roller 21 and the degradation of the fixing roller 21 due to the overheating when the recording media P of A5T sheets are continuously fed and the detection temperature of the non-contact-type thermistor 36 is equal to or greater than a predetermined temperature (e.g., 165° C.), a speed of feeding the recording media P of A5T sheets is reduced (controlled). For example, sheet feeding speed of the recording media P of A5T sheets is reduced from 50 sheets/min to 40 sheets/min.

Further, it is assumed that when a predetermined number (herein, for example 100 sheets) of the recording media P of A5T sheets are continuously fed, the temperature of the non-sheet feeding region of the fixing roller 21 reaches approximately 220° C. When the temperature of the fixing roller 21 is incorrectly detected due to a failure of the non-contact-type thermistor 36 or the like, there may be a concern that the temperature of the fixing roller 21 exceeds the heat resistance temperature and the fixing roller 21 is degraded. To prevent the inconveniences, in a case where the number of the recording media P of A5T sheets continuously fed reaches the predetermined number (herein, for example 100 sheets), even when the detection temperature of the non-contact-type thermistor 36 is still less than a predetermined temperature (e.g., 165° C.), it is determined that the actual temperature of the pressing roller 23 reaches 170° C., and the speed of feeding the recording media P of A5T sheets is reduced (controlled). For example, the sheet feeding speed of the recording media P of A5T sheets is reduced from 50 sheets/min to 40 sheets/min.

By performing the control described above, it may become possible to reduce the temperature of the fixing roller 21 and prevent the increase of the temperature of the fixing roller 21 beyond the heat resistance temperature of the fixing roller 21 and the degradation of the fixing roller 21.

Further, even when the number of recording media P of A5T sheets continuously fed is equal to or greater than a predetermined number (e.g., 100 sheets), if the detection temperature of the non-contact-type thermistor 36 is equal to or less than a predetermined temperature (e.g., 140° C.), it is determined that there is a failure in the temperature detection system including the non-contact-type thermistor 36 and the operation of the fixing device 20 is stopped. By performing the control as described above, it may become possible to detect a failure of the temperature detection system including the non-contact-type thermistor 36 and safely stop the operation of the fixing device 20.

Next, an example is described where the fixing device 20 includes a mechanism to change the pressing force of the pressing roller 23. Specifically, the fixing device 20 includes a mechanism to change the pressing force of the pressing roller 23 by changing the distance between the axles of the fixing roller 21 and the pressing roller 23. By having the mechanism and moving the pressing roller 23 to a position where no pressing force of the pressing roller 23 on the fixing roller 21 is necessary (pressure release position), it may become possible to prevent the plastic deformation of the fixing roller 21 and the pressing roller 23.

Figure 8A:
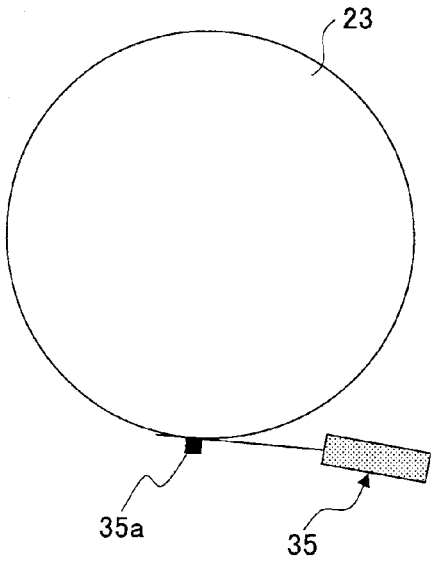
FIGS. 8A and 8B are drawings illustrating when a pressing roller is disposed at a pressing position and a non-pressing position, respectively.
Figure 8B:
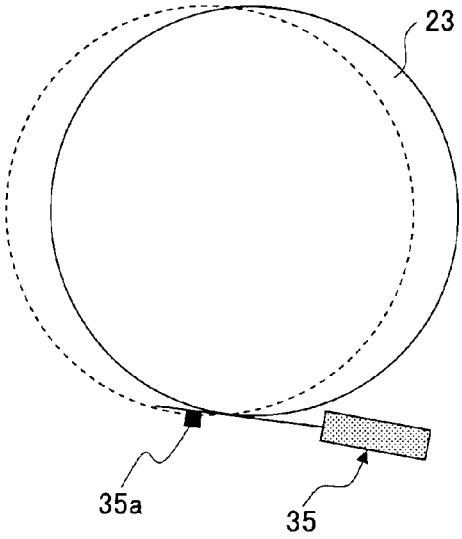

FIG. 8A illustrates where the pressing roller 23 is at a pressing position where the pressing force of the pressing roller 23 is applied to the fixing roller 21 (not shown). FIG. 8B illustrates where the pressing roller 23 is at the pressure release position. In FIGS. 8A and 8B, the contact-type thermistor 35 includes a temperature detection section 35*a*. In the case where the pressing roller 23 is at the pressing position (FIG. 8A), the temperature detection section 35*a* is in contact with the pressing roller 23. On the other hand, in the case where the pressing roller 23 is at the pressure release position (FIG. 8B), the temperature detection section 35*a* is not in contact with the pressing roller 23. Therefore, when compared with the case where the pressing roller 23 is at the pressing position (FIG. 8A), a temperature lower than the actual temperature of the pressing roller 23 is detected in the case where the pressing roller 23 is at the pressure release position (FIG. 8B) because the temperature detection section 35*a* is separated from the pressing roller 23.

Herein, it is assumed that the temperature detected when the pressing roller 23 is at the pressure release position (FIG. 8B) is lower than the temperature detected when pressing roller 23 is at the pressing position (FIG. 8A) by approximately 10° C. In this case, when a difference between the temperature detected when the pressing roller 23 is at the pressure release position and the temperature detected when pressing roller 23 is at the pressing position is equal to or greater than a predetermined value (e.g., 10° C.), it is determined that there is a failure in the temperature detection system including the contact-type thermistor 35 and the operation of the fixing device 20 is stopped. By performing the control as described above, it may become possible to detect a failure of the temperature detection system including the contact-type thermistor 35 and safely stop the operation of the fixing device 20.

According to an embodiment of the present invention, there is provided a fixing device capable of eliminating the unnecessary wait time and appropriately determining whether the warm-up operation is finished. Also there is provided an image forming apparatus including the fixing device.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

For example, in the above description, a case is described where the fixing device includes the fixing roller, the pressing roller, IH (Induction Heater) coil and the like. However, the present invention is not limited to such a configuration. For example, the present invention may also be applied to a fixing device including a fixing belt stretched between the fixing roller and the pressing roller. Further, the present invention may also be applied to a fixing device including a nip forming member and a slidable fixing belt, and plural thermistors provided for the pressing roller.

Further, in the above description, a case is described where the image forming apparatus is a laser printer. However, the image forming apparatus of the present invention is not limited to the laser printer. For example, the image forming apparatus of the present invention may be a copier, any printers other than the laser printer, a facsimile machine, a printing machine and the like.

What is claimed is:

1. A fixing device comprising:

a fixing rotation body configured to be in contact with a side of a recording medium, an unfixed image formed on the side of the recording medium, and heat and fix the unfixed image onto the recording medium;

a pressing rotation body configured to be in contact with another side of the recording medium, no unfixed image being formed on the other side of the recording medium, and press the recording medium to the fixing rotation body; and a temperature detection unit configured to detect a temperature of the pressing rotation body;

wherein in a case where an input voltage rate to the fixing device is equal to or greater than a predetermined value and an outside air temperature is equal to or greater than a predetermined value, the fixing device determines that the warm-up operation is finished when a predetermined time period has elapsed since a warm-up operation has started before a temperature detected by the temperature detection unit is equal to or greater than a predetermined temperature or when the temperature detected by the temperature detection unit is equal to or greater than the predetermined temperature before the predetermined time period elapses since the warm-up operation has started.

2. The fixing device according to claim 1, further comprising:

a non-contact-type thermistor configured to detect a temperature of a sheet feeding region of the pressing rotation body; and a contact-type thermistor configured to detect a temperature of a non-sheet feeding region of the pressing rotation body;

wherein the temperature detection unit is the contact-type thermistor.

3. The fixing device according to claim 2, wherein when the temperature detected by the contact-type thermistor does not reach a predetermined failure detection temperature before the predetermined time period elapses since the warm-up operation has started, it is determined that there is a failure in a temperature detection system including the contact-type thermistor and an operation of the fixing device is stopped.

4. The fixing device according to claim 2, wherein plural recording media having different width sizes and including a first recording medium having a predetermined width size and a second recording medium having a width size greater than the width size of the first recording medium can be fed through the fixing device, wherein the non-contact-type thermistor is disposed in a region included in the non-sheet feeding region when the first recording medium is fed and in the sheet feeding region when the second recording medium is fed, wherein when the first recording medium is continuously fed and the temperature detected by the non-contact-type thermistor is equal to or greater than a predetermined temperature, or when a number of the first recording media continuously fed is equal to or greater than a predetermined number, a speed of feeding the first recording medium is reduced.

5. The fixing device according to claim 4, wherein when the number of the first recording media continuously fed is equal to or greater than a predetermined number, if the temperature detected by the non-contact-type thermistor is not equal to or greater than a predetermined failure detection temperature, it is determined that there is a failure in a temperature detection system including the non-contact-type thermistor and an operation of the fixing device is stopped.

6. The fixing device according to claim 2, further comprising:

a mechanism configured to change a pressing force of the pressing rotation body;

wherein a comparison is made between a temperature detected by the contact-type thermistor when the pressing rotation body is disposed at a pressing position and a temperature detected by the contact-type thermistor when the pressing rotation body is disposed at a pressure release position, and when a difference between the temperature when the pressing rotation body is disposed at the pressing position and the temperature when the pressing rotation body is disposed at the pressure release position is equal to or greater than a predetermined value, it is determined that there is a failure in a temperature detection system including the contact-type thermistor and an operation of the fixing device is stopped.

7. The fixing device according to claim 2, further comprising:

a thermopile configured to detect a temperature of a center part of the fixing rotation body;

wherein under conditions that a temperature detected by the thermopile is substantially equal to a room temperature and the fixing device is not heated, a comparison is made between a temperature detected by the thermopile and the temperature detected by the non-contact-type thermistor, and when a difference between the temperature detected by the thermopile and the temperature detected by the non-contact-type thermistor is equal to or greater than a predetermined value, it is determined that there is a failure in a temperature detection system including the non-contact-type thermistor and an operation of the fixing device is stopped.

8. An image forming apparatus comprising:

the fixing device according to claim 1.

* * * * *